United States Patent [19]

Montrym

[11] Patent Number: 4,875,801

[45] Date of Patent: Oct. 24, 1989

[54] EXPANSION JOINT BRACE AND ALIGNER

[76] Inventor: Anthony Montrym, 1333 Woodpath, Florissant, Mo. 63031

[21] Appl. No.: 193,243

[22] Filed: May 11, 1988

[51] Int. Cl.[4] ..... E01C 11/02

[52] U.S. Cl. ..... 404/48; 404/74; 404/87

[58] Field of Search ..... 404/47, 48, 55, 68, 404/74, 87; 249/2, 3, 9; 52/699

[56] References Cited

U.S. PATENT DOCUMENTS

| | | | |
|---|---|---|---|
| 1,255,611 | 2/1918 | Innes | 249/9 X |
| 1,267,301 | 5/1918 | Wieberg | 404/87 |
| 1,508,545 | 9/1924 | Foster | 404/87 |
| 1,562,257 | 11/1925 | Rogers | 404/87 |
| 1,584,443 | 5/1926 | Fischer | 404/87 |
| 1,664,605 | 4/1928 | Fischer | 404/87 |
| 1,804,215 | 5/1931 | Fischer | 404/87 |
| 2,976,781 | 3/1961 | Heltzel | 404/48 |

*Primary Examiner*—Jerome W. Massie
*Assistant Examiner*—Matthew Smith
*Attorney, Agent, or Firm*—Haverstock, Garrett and Roberts

[57] ABSTRACT

A removable concrete expansion joint aligner and brace having an elongated base plate with a parallel row of ground pegs attached to the bottom and with a parallel set of aligning pegs mounted on the bottom in a position slightly removed from the parallel line of ground pegs so that an expansion joint may be held in position between the ground pegs and aligning pegs while fresh concrete is poured against at least one side of the expansion joint held in place by the expansion joint aligner.

3 Claims, 1 Drawing Sheet

EXPANSION JOINT BRACE AND ALIGNER

FIELD OF THE INVENTION

The present invention relates to a device for inserting expansion joints in concrete formations and more specifically, relates to a removable expansion joint aligner generally utilized for bracing and aligning expansion materials between concrete slabs of driveways, sidewalks and the like.

BACKGROUND OF THE INVENTION

In concrete constructions such as sidewalks and driveways, expansion joints provide that the concrete slabs, rather than breaking, may move to eliminate stress due to environmental elements such as water freezing under the concrete. For example, a typical sidewalk has expansion joints positioned about every five feet and a typical driveway has expansion joints about every eight feet. Expansion joints typically are made from materials such as cedar wood or asbestos impregnated celloulosic material which withstand weathering and aging. Other useful expansion joint materials include plastic joints and fibrous mesh materials.

In a typical concrete construction, wooden forms, held in place by stakes, confine fresh concrete. Specifically, the wooden forms are placed in desired locations and then expansion joints typically are placed adjacent to one side of the forms. Wooden or steel pegs hold the forms and joints in the desired position. Concrete then is poured in the areas defined by the forms. Since it is impractical to pour concrete a section at a time, it is necessary to pour a large amount of coverage at one time and then work the concrete as it begins to harden. A skillful concrete finisher will know just about when he can enter onto the concrete, usually on some large flat surface such as a section of plywood, and remove the forms. The expansion joints are left in place and a worker then fills interstices left by removing the forms with fresh concrete after which the entire slabs are allowed to set.

The problem of confining freshly poured concrete until it sets is long standing. U.S. Pat. No. 1,495,305, issued in 1924, discloses a system for using side rails to confine concrete and also to function as rails for a creeping concrete mixer used to pour the concrete. This system is still in use today in the fabrication of large concrete projects such as highways.

U.S. Pat. No. 4,198,176, issued in 1980, discloses a concrete expansion joint construction made from bent metallic sheet material formed to include a central trough adapted to receive an expansion joint wherein the entire structure remains permanently imbedded in the concrete. No completely satisfactory system and equipment for retaining fresh concrete has been developed which can be installed and removed quickly with minimum labor.

SUMMARY OF THE INVENTION

The present invention overcomes the disadvantages and shortcomings of known related art and functions both as a concrete form and also as a support for holding expansion joint material in place which can be easily inserted and removed from a concrete formation. The invention generally includes a metal plate with metal ground pegs and aligning pegs attached thereon. The plate generally will have a V-cross-sectional shape which provides that when concrete is poured around the device, concrete will not form and harden on the top of the plate. Thus, the V-shape provides that the device is easily and quickly removed from a concrete formation. It is contemplated, however, the device could have various cross-sectional shapes. The metal plate may be constructed to any desired length, and the number of ground pegs and aligning pegs may vary accordingly. The length, distance, and size can vary depending upon the particular application and expansion joints being utilized. For example, with very narrow walkways, a relatively short angular plate and only one or two ground pegs and aligning pegs will be required.

The invention also includes optional handles mounted on the plate on the opposite side from the pegs. The handles generally are positioned so that a worker may easily remove the device when desired.

The material used to make the expansion joint aligner of this invention may be any known rigid construction material such as reinforced plastics or metals but generally is steel or aluminum.

In operation, the present device is positioned at a desired location and the ground pegs are driven into the ground. Expansion material may then be placed along the length of the plate in the space defined by and between the ground pegs and the aligning pegs. The ground pegs and aligning pegs prevent the material from undergoing lateral movement and the plate and ground prevent vertical movement. Thus, the expansion material is firmly and positively held in the desired position.

After the expansion joint aligner, with the expansion joint held firmly in place, is in position to retain freshly poured concrete, fresh concrete is generally poured on both sides of the expansion joint aligner and expansion joint to the level of the top of the expansion joint. Generally, concrete will not be poured over the top of the expansion joint because doing so would frustrate the purpose of the joint. After the fresh concrete has been allowed to partially set, concrete finish workers may remove the expansion joint aligner by lifting it straight up. The expansion joint, however, will be held in place with the concrete formation by the concrete formed adjacent to the joint. Thereafter, the concrete finisher can finish around the expansion joint in the customary manner to leave a neat and hardly noticeable joint. In the construction of sidewalks, it is a common practice to work an edger along the sides and adjacent the expansion joint which leaves a rounded edge and provides a neat appearance and an edge which will not chip.

This invention may also be used in single slab constructions. If a single slab is desired, the expansion joint aligner, with the expansion joint in position, may be secured in place by driving the ground pegs into the ground, preferably with the aligning pegs and expansion joint on the side fresh concrete will be poured. In pouring a unitary slab, it will be necessary to leave the expansion joint aligner in place somewhat longer than if fresh concrete is poured on both sides in order to make sure that the curing concrete will not be crumbled as the expansion joint aligner is removed. Also, the expansion joint aligner of this invention may be used to retain an expansion joint in place when fresh concrete is being poured against previously cured concrete.

DETAILED DESCRIPTION OF THE INVENTION

Figure 1:
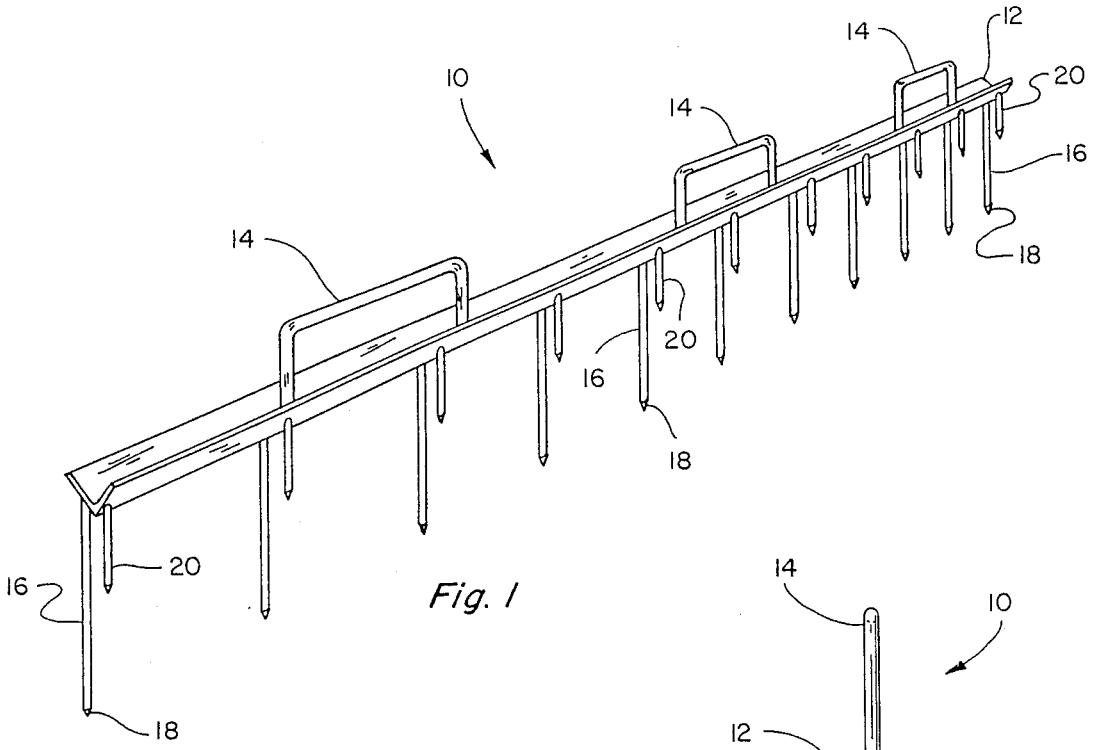
FIG. 1 is a perspective view of a preferred embodiment of the present invention.

With reference to the drawings, wherein like numbers identify like parts, expansion joint brace and aligner 10 in FIG. 1 includes an enlongated angular base plate 12 which, as shown, may have a V-cross-sectional shape but which may be also in the form of a flat plate or any other configuration desired by the user. The V-cross-sectional shape, however, generally is preferred because the angularly positioned sides prevent concrete from forming and hardening on the top surface of the plate thereby facilitating quick and easy removal.

One or more handles 14 may be attached to the top of the elongated plate as a convenience in removing the expansion joint aligner after use. The handles 14 generally may have a C-cross-sectional shape as shown in the drawings or they may be of any other configuration such as right angle bars, circular handles or any other suitable construction. The handles are intended as a convenience in removing the expansion joint aligner after use and may be omitted for some uses such as very light construction.

Ground pegs 16 are attached to the elongated base plate on the opposite side from the handles and are long enough to be driven into the ground to hold the expansion joint aligner in position while concrete is poured on one or both sides. The ground pegs 16 generally are from ¼ inch to 1 inch in diameter and generally about 6 inches to about 10 inches long. The ground pegs 16 have sharpened points 18 so that the expansion joint aligner 10 may be more easily driven into any type of ground surface. Ground pegs 16 will be spaced apart and generally in a parallel plane which extends generally downward at right angle to the plane of the top of elongated plate 12.

Aligning pegs 20 are attached to the bottom of elongated plate 12. Aligning pegs 20 also will be spaced apart generally in a parallel plane which is at an approximately right angle to the plane of the top of elongated plate 12. The plane of aligning pegs 20 will be generally parallel with the plane of ground pegs 16 and the plane of aligning pegs 20 will be spaced apart from the plane of ground pegs 16 in order to accept, in reasonably snug relationship, an expansion joint.

Aligning pegs 20 will be similar in configuration to ground pegs 16 except that aligning pegs 20 will be generally shorter than ground pegs 16 because their function is to hold expansion joint 22 generally in precise relationship with the poured concrete in order to have a straight and neat final joint whereas ground pegs 16 are for the purpose of holding the expansion joint aligner in positive and rigid relationship with the ground.

Figure 2:
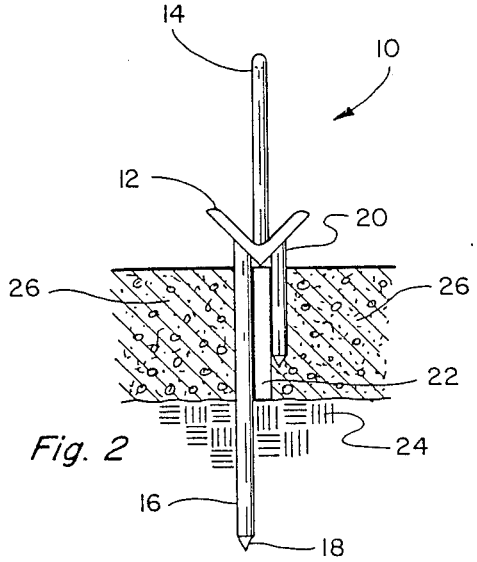
FIG. 2 is an end elevation view of the present invention with an expansion joint in place and concrete forming therearound; and, FIG. 3 is a fragmented top plan view of this invention.

FIG. 2 shows an end elevation view of expansion joint aligner 10 in use. Ground pegs 16 with sharpened points 18 are shown driven into ground 24 to retain the expansion joint aligner in rigid position. Aligning pegs 20 extend into fresh concrete 26 only far enough to hold expansion joint 22 in position so that the top of expansion joint 22 will be at the surface of poured concrete 26.

Figure 3:
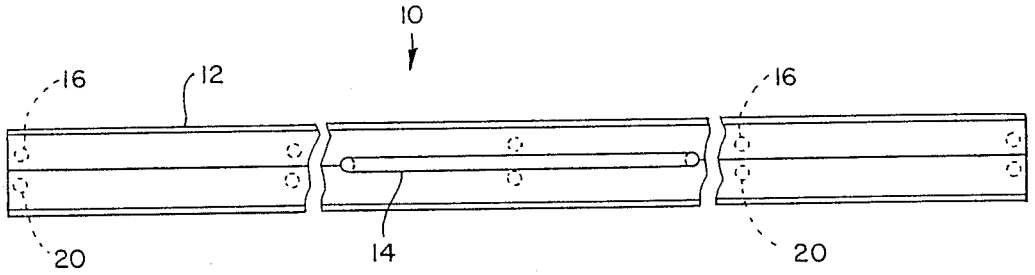

FIG. 3 shows a fragmented top plan view of the expansion joint aligner 10 of this invention. Elongated plate 12 is shown in fragmented sections. Handles 14 are shown in place on top of elongated plate 12. Handles 14 in a C-configuration are preferred because concrete finishers may remove expansion joint aligner 10 easily and quickly by inserting poles through at least two of the C-configuration handles 14 and thereafter gently lift expansion joint aligner 10 from the concrete leaving expansion joint 24 in place.

It is also preferred that expansion joint aligner 12 be in the configuration of an inverted V because this allows a concrete finisher to work the fresh concrete around the expansion joint while still quite wet. The V-cross-sectional shape, however, generally is preferred because the angularly positioned sides prevent concrete from forming and hardening on a top surface of the plate thereby facilitating quick and easy removal.

EXAMPLE

A device was constructed according to the present invention and with the following specifications and results. An expansion joint aligner was fabricated with an elongated base plate made from standard steel angle bar which was 2 inches by 2 inches by ¼ inch with a 90° angle. The fabricated section was 8 feet long. The elongated base plate had three C-shaped handles mounted on the top or open portion of the V-construction in substantially perpendicular relationship to a plane across the edges of the V-construction. The two handles were from ⅜ inch diameter bar stock, were 6 inches long and 10½ inches apart.

Eleven ground pegs made from ⅜ inch diameter steel were welded to the underside of one leg of the V-shaped elongated base plate. Each ground peg was about 8 inches long and sharpened on the end.

A row of aligning pegs similar to the grounding pegs but 4 inches long were welded to the underside of the other leg of the angle shaped elongated base plate in a plane parallel with the plane of the corresponding ground pegs. The space between the plane of the aligning pegs and the plane of the grounding pegs was about ½ inch.

A tarred Celotex fibrous expansion joint was placed in the space between the ground pegs and the aligning pegs and the ground pegs were driven into the ground with a sledge hammer. Fresh concrete was poured on both sides of the expansion joint, in the expansion joint aligner. While the concrete was still soft, but beginning to set, the expansion joint aligner was pulled straight up out the wet concrete by means of the handles leaving the expansion joint in place and held in place by the wet concrete. After the expansion joint aligner was removed, normal finishing was completed.

The preferred embodiment of this invention includes a unitary plate with the ground pegs and aligning pegs rigidly attached thereto. However, various means of accomodating various widths of expansion joints are also contemplated. For example, the elongated plate could be in one plane with multiple rows of holes through which rows of ground pegs and aligning pegs could be bolted. Also, the elongated plate could be in telescoping sections with the ground pegs and aligning pegs attached to alternate sections which could be collapsed together to confine the expansion joint. Also, reinforcing rods may be pushed through the expansion joint material between the ground pegs and aligning pegs to hold slabs of concrete together.

While this invention has been described with respect to the preferred specific embodiments, it will be understood that many modifications and variations may occur to those skilled in the art without departing from the spirit and scope of this invention as defined in the claims.

I claim:

1. A concrete expansion joint aligner for supporting and aligning an expansion joint which may be removed after poured concrete adjacent to the expansion joint begins to harden while leaving the expansion joint in place comprising:

a unitary construction, said unitary construction being comprised of an elongated base plate having a plurality of ground pegs and a plurality of aligning pegs permanently attached thereto and projecting from said elongated base plate in a substantially perpendicular relationship with respect to said base plate wherein a row of said aligning pegs is substantially parallel with a row of said ground pegs, the space defined by and between said ground pegs and said aligning pegs being adapted to retain an expansion joint in place while fresh concrete is poured against at least one side of said expansion joint, and wherein said ground pegs extend further from said base plate than said aligning pegs.

2. A concrete expansion joint aligner for supporting and aligning an expansion joint which may be removed after poured concrete adjacent to the expansion joint begins to harden while leaving the expansion joint in place comprising:

a unitary construction, said unitary construction being comprised of an elongated base plate having a plurality of ground pegs and a plurality of aligning pegs permanently attached thereto and projecting from said elongated base plate in a substantially perpendicular relationship with respect to said base plate wherein a row of said aligning pegs is substantially parallel with a row of said ground pegs, the space defined by and between said ground pegs and said aligning pegs being adapted to retain an expansion joint in place while fresh concrete is poured against at least one side of said expansion joint, and wherein said ground pegs extend further from said base plate than said aligning pegs, wherein said elongated base plate has a V-cross -sectional shape.

3. A process for pouring fresh concrete in a continuous strip with periodic expansion joints in place in said continuous strip comprising putting in place opposite continuous sidewalls to condine said fresh concrete, putting in place a unitary construction concrete expansion joint aligner between said parallel side walls in transverse relationship therewith by placing said concrete expansion joint in the interstices between a series of ground pegs and a series of aligning pegs both fixedly attached to an elongated base plate in perpendicular relationship thereto, thereafter, placing said unitary construction expansion joint alignr confining said expansion joint by driving said ground pegs into the ground to a distance sufficient to align the top of said expansion joint with said side walls, pouring fresh concrete against both sides of said expansion joint held in place by said expansion joint aligner, after said concrete becomes partially cured, removing said unitary construction expansion joint alginer while leaving said expansion joint in place to define abutting sections of poured concrete.

* * * * *

UNITED STATES PATENT AND TRADEMARK OFFICE

CERTIFICATE OF CORRECTION

PATENT NO. : 4,875,801

DATED : October 24, 1989

INVENTOR(S) : Anthony Montrym

It is certified that error appears in the above-identified patent and that said Letters Patent is hereby corrected as shown below:

column 6, line 19, "condine" should be --confine--.

column 6, line 28, "alignr" should be --aligner--.

Signed and Sealed this

Sixth Day of November, 1990

*Attest:*

HARRY F. MANBECK, JR.

*Attesting Officer*

*Commissioner of Patents and Trademarks*